United States Patent [19]

Sanchez et al.

[11] Patent Number: 4,883,197

[45] Date of Patent: Nov. 28, 1989

[54] SAMPLE STRIP AND DISPENSING APPARATUS THEREFOR

[75] Inventors: Hernando Sanchez, New York, N.Y.; Richard M. Franczak, Laurence Harbor, N.J.; Menachem Futter, Staten Island, N.Y.

[73] Assignee: Revlon, Inc., New York, N.Y.

[21] Appl. No.: 98,279

[22] Filed: Sep. 18, 1987

[51] Int. Cl.[4] ..... B65H 3/58; G07F 11/00

[52] U.S. Cl. ..... 221/26; 221/27; 221/70

[58] Field of Search ..... 221/74, 26, 27, 69, 221/70, 71, 73; 156/344, 352, 541, 584; 206/343, 345

[56] References Cited

U.S. PATENT DOCUMENTS

| | | | |
|---|---|---|---|
| 405,412 | 6/1889 | Hicks . | |
| 453,003 | 5/1891 | Hicks . | |
| 1,122,456 | 12/1914 | Woods . | |
| 1,652,402 | 12/1927 | Friedman . | |
| 1,744,532 | 1/1930 | Ean . | |
| 2,061,139 | 11/1936 | Cohen | 206/82 |
| 2,088,076 | 7/1937 | Winslow | 35/59 |
| 2,175,133 | 10/1939 | Singleton | 132/79 |
| 2,221,213 | 11/1940 | Borden . | |
| 2,234,657 | 3/1941 | Smaldone | 132/73 |
| 2,274,238 | 2/1942 | Henderson et al. | 312/48 |
| 2,343,064 | 2/1944 | Kjorsvik . | |
| 2,378,935 | 6/1945 | Kraft | 132/73 |
| 2,561,400 | 7/1951 | Morrell | 132/79 |
| 2,574,365 | 11/1951 | Hough et al. | 221/71 X |
| 2,758,710 | 8/1956 | Arens | 206/56 |
| 2,998,821 | 9/1961 | Hurdel | 132/88.7 |
| 3,007,619 | 11/1961 | Burcz . | |
| 3,088,640 | 5/1963 | Kunsch . | |
| 3,157,912 | 11/1964 | Lisczawka | 18/5.1 |
| 3,258,017 | 6/1966 | Albert . | |
| 3,337,547 | 7/1967 | Rowe et al. . | |
| 3,380,578 | 4/1968 | Sparks | 206/56 |
| 3,386,619 | 6/1968 | Douglas . | |
| 3,482,733 | 12/1969 | Groves | 221/25 |
| 3,485,349 | 12/1969 | Chaney . | |
| 3,494,505 | 2/1970 | Huebner et al. . | |
| 3,583,558 | 6/1971 | Davis . | |
| 3,598,685 | 8/1971 | Lee et al. . | |
| 3,674,176 | 7/1972 | Sagi . | |
| 3,698,600 | 10/1972 | Foote . | |
| 3,709,403 | 1/1973 | Harriman . | |
| 3,788,917 | 1/1974 | Linda | 156/82 |
| 3,811,987 | 5/1974 | Wilkinson et al. | 156/497 |
| 3,835,992 | 9/1974 | Adams . | |
| 3,858,722 | 1/1975 | Haas . | |
| 3,861,560 | 1/1975 | Entwistle et al. . | |
| 3,885,724 | 5/1975 | Ehrlund . | |
| 3,964,638 | 6/1976 | Dimauro | 221/3 |
| 3,984,030 | 10/1976 | Monni . | |
| 4,032,004 | 6/1977 | Coates . | |
| 4,111,333 | 9/1978 | Norgaard . | |
| 4,121,004 | 10/1978 | Ehrlund . | |
| 4,150,741 | 4/1979 | Rubin . | |
| 4,180,181 | 12/1979 | Brandwein | 221/70 |
| 4,224,092 | 9/1980 | Thompson et al. | 156/82 |
| 4,274,550 | 6/1981 | Feldstein . | |
| 4,387,831 | 6/1983 | McNally . | |
| 4,437,579 | 3/1984 | Obland . | |
| 4,457,427 | 7/1984 | Catiero | 206/484 X |
| 4,550,857 | 11/1985 | Castner, Sr. et al. . | |
| 4,576,311 | 3/1986 | Horton et al. . | |
| 4,611,611 | 9/1986 | Beal, Jr. . | |
| 4,637,523 | 1/1987 | Levasseur . | |
| 4,653,664 | 3/1987 | Hineno et al. | 221/74 X |
| 4,751,934 | 6/1988 | Moir et al. | 132/79 D |

FOREIGN PATENT DOCUMENTS

| | | | |
|---|---|---|---|
| 598710 | 5/1960 | Canada . | |
| 1218492 | 6/1966 | Fed. Rep. of Germany . | |
| 1511865 | 10/1966 | Sweden | 221/71 |

*Primary Examiner*—Kevin P. Shaver
*Assistant Examiner*—Mona C. Beegle

[57] ABSTRACT

A sample strip is divided into a plurality of individual pieces arranged seriatim and connected in end-to-end fashion. The individual pieces are separated from each other as the strip is incrementally fed through a dispensing tip of a cartridge which controls the dispensing operation to insure that the samples are dispensed one at a time in a hygienic manner. The cartridge can be mounted in a display unit along with a plurality of similar cartridges.

59 Claims, 5 Drawing Sheets

SAMPLE STRIP AND DISPENSING APPARATUS THEREFOR

FIELD OF THE INVENTION

The present invention relates to strips adapted to be dispensed from dispensing apparatus in such a manner that each strip is separated into a plurality of individual pieces, and, more particularly, to such strips and apparatus which are especially useful in the dispensing of product or test samples.

BACKGROUND OF THE INVENTION

Users of cosmetics often prefer to try a sample of a particular cosmetic preparation, such as lipstick, mascara, rouge, etc., before actually purchasing it. Thus, it is common in the cosmetics industry to provide point-of-purchase samplers. These samplers are often in the form of a container or tray which is available for public use. That is, one and the same sampler may be used by various different consumers. The indiscriminate use of such samplers creates a potentially non-hygienic condition, as well as the possibility that diseases may be transmitted from one user to another. Also, the uncontrolled use of such samplers could result in waste if, for instance, a user overindulges herself or himself.

In the past, it has been proposed to prepackage numerous different types of articles in a continuous strip consisting of a plurality of individual packages adapted to be manually separated from the strip by a user (see, for instance, U.S. Pat. No. 4,387,831 in which items such as batteries, razor blades, pens and lipstick are so packaged and U.S. Pat. Nos. 3,709,403 and 3,858,722 in which items such as toothpicks, needles, drill bits and pens are so packaged). However, such a packaging technique has not, heretofore, been applied to test samples of any type, let alone to cosmetic test samples which, in order to be effective and acceptable to consumers, would necessitate the quick and easy access to a transferable cosmetic preparation, such as a powder, paste or cream, whose sanitary condition must be substantially maintained until it is sampled by a consumer.

SUMMARY OF THE INVENTION

The present invention overcomes the problems and disadvantages described above by providing a unique strip which can be separated into a plurality of individual pieces by, for instance, a new and improved dispensing apparatus. The pieces may contain removable test samples, but they could also contain non-removable product samples or even indelible identifying indicia. For use in the cosmetics field especially, the test samples can be a predetermined size to thereby control sample waste. Also, because the test samples are contained on separate pieces of the sample strip which are designed to be dispensed individually, individually-sized test samples can be dispensed to consumes from a single source in a relatively hygienic or sanitary manner.

In accordance with one aspect of the present invention, an incrementally dispensable strip includes dividing lines which extend across substantially the entire width of the strip from one of its side edges to an opposite side edge. The dividing lines are also spaced apart along the length of the strip such that the strip is divided into a plurality of individual pieces arranged seriatim and connected in end-to-end fashion. As used herein, the term "dividing lines" means any kind of line of demarcation which defines a weakened boundary region adapted to facilitate separation of two adjoining pieces. Thus, this term includes, but is not limited to, tear lines, crease lines, score lines, die cut lines, lines formed by perforations, etc.

Each of the individual pieces of the strip includes a nose section which has a size and shape selected such that it is spaced from both side edges of the strip. A midsection extends rearwardly from its associated nose section and terminates at a nose section of a trailing piece, the midsection extending across the strip from one side edge to an opposite side edge. A tail section includes a pair of legs, each leg extending rearwardly from its associated midsection and terminating at a midsection of a trailing piece. One leg is arranged adjacent to one side edge of the strip, while the other leg is arranged adjacent to the other side edge of the strip, whereby the legs straddle a nose section of the trailing piece so as to present contact surfaces for force-exerting members of a dispensing tip.

In operation, as the strip passes through the dispensing tip, the force-exerting members do not exert any substantial force on the trailing piece until its midsection reaches the force-exerting members at which time the leading piece can be separated from the trailing piece along an interposed dividing line by pulling on the leading piece as the trailing piece is maintained substantially stationary due to the force exerted on its midsection by the force-exerting members. Both legs have a length selected such that, upon the separation of the leading piece from the trailing piece, a nose section of the trailing piece, which now becomes a leading piece, projects outwardly from the dispensing tip a distance sufficient to permit it to be gripped by a user.

If each of the individual pieces contains a transferable cosmetic sample, which typically would be in the form of a powder, paste or cream, the strip is provided with a protective covering adapted to inhibit contamination of the samples and to thereby maintain their integrity until a desired sampling operation takes place. In the event that the strip is provided in roll form, the protective covering also functions to inhibit the samples from being rubbed off onto the back of the strip. By attaching the protective covering to the marginal portions only of the strip, the covering will only be attached to the midsection and the tail section of a separated piece, whereby the covering can be readily lifted off of the nose section to expose all or part of the test sample contained thereon.

In accordance with another aspect of the present invention, the force-exerting members of the dispenser constantly exert a compressive force against marginal portions only of the strip in a direction generally perpendicular to a longitudinal axis of the strip (in the event that the strip is flat) or to an imaginary line which is tangent to a longitudinal axis of the strip (in the event that the strip is curved). This compressive force creates drag on a trailing piece supplied to the dispensing tip as a result of the withdrawal therefrom of a leading piece which is connected to the trailing piece. By calculating the drag such that it is greater than the tensile force required to separate the leading piece from the trailing piece, the leading piece can be separated from the trailing piece by pulling on the leading piece as the trailing piece is maintained in the dispensing tip due to the drag which acts on the trailing piece to inhibit its movement as the leading piece is separated therefrom.

In one embodiment, the dispensing tip includes a passageway through which the strip passes during a dispensing operation. A runway is positioned on one side of the passageway, while a pair of resilient fingers is positioned on an opposite side of the passageway in contact with or in close proximity to the runway. The fingers extend into the passageway far enough to create an interference fit for the strip. Thus, as the strip moves through the passageway, the fingers cooperate with the runway to squeeze the strip therebetween.

The dispenser can be provided in the form of a disposable cartridge. If the strip is provided in the form of a roll, the cartridge can be equipped with a holder adapted to hold the roll such that the strip can be unwound therefrom.

In order to facilitate the separation of two adjoining pieces, the fingers may be provided with cutting ribs designed to completely or partially cut otherwise unsevered or non-weakened portions of the strip at preselected locations along an interposed dividing line prior to the complete separation of the pieces. Such complete or partial severing of otherwise unsevered or non-weakened portions of the strip reduces the tensile force required to fully separate the pieces.

A plurality of cartridge-type dispensers may be removably mounted in a housing adapted for point-of-purchase display. Thus, several different types and/or colors of cosmetic samples or similar samples can be separately dispensed from a single unit. When all of the individual test samples have been dispensed from one of the dispensers, that particular dispenser can be supplied with a new sample strip and reused or the entire dispenser can be disposed of and replaced with a new cartridge-type dispenser, which would include a new sample strip.

BRIEF DESCRIPTION OF THE DRAWINGS

For a better understanding of the present invention, reference is made to the following detailed description considered in conjunction with the accompanying drawings, in which.

DETAILED DESCRIPTION

Figure 1:
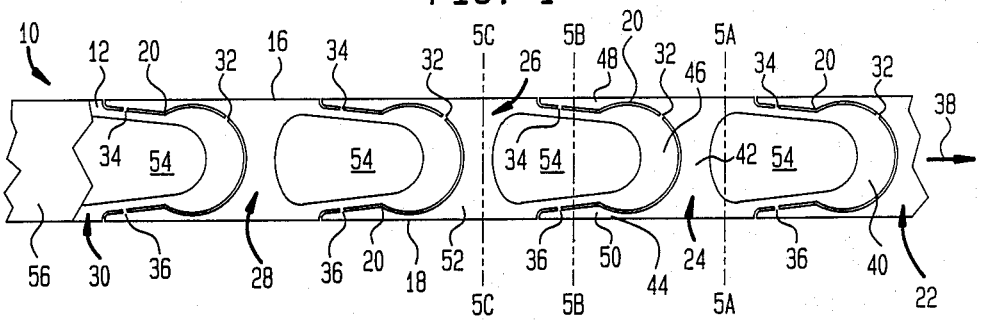
FIG. 1 is a partial plan view of a sample strip constructed in accordance with one aspect of the present invention, a portion of the strip being broken away to facilitate consideration and discussion.

With reference to FIG. 1, a sample strip 10, which is preferably made from a material having sufficient flexibility such that the strip 10 can be provided in the form of a roll (see FIG. 2), includes an upper surface 12, a lower surface 14 (see FIG. 2) and side edges 16, 18. Dividing lines 20, which extend across and through the strip 10, are spaced along the length of the strip 10 so as to divide the strip 10 into a plurality of individual pieces 22, 24, 26, 28, 30 arranged seriatim and connected in end-to-end fashion by nicks 32, 34, 36 which interrupt the dividing lines 20 at preselected locations therealong.

To facilitate consideration and discussion, only the piece 24 will now be described in greater detail and in relation to its adjoining piece 26, it being understood that all of the pieces 22, 24, 26, 28, 30 are essentially identical to each other. Bearing such an understanding in mind and bearing in mind further that the strip 10 is designed to be fed in the direction of arrow 38, the piece 24 includes a nose section 40, a midsection 42 and a tail section 44. The nose section 40 has a size and shape selected such that there is a space between it and the side edges 16, 18 of the strip 10. The midsection 42 extends rearwardly from the nose section 40 and terminates at a nose section 46 of the piece 26, which follows or trails the piece 24 as the strip 10 is fed in the direction of the arrow 38. Unlike the nose section 40, the midsection 42 extends across the entire width of the strip 10. The tail section 44 includes legs 48, 50 which extend rearwardly from the midsection 42 and terminate at a midsection 52 of the piece 26. The leg 48 is arranged adjacent to the side edge 16 of the strip 10, while the leg 50 is arranged adjacent to the side edge 18 of the strip 10, whereby the legs 48, 50 straddle the nose section 46 of the piece 26.

Returning now to a general discussion of strip 10 without any particular reference to the pieces 24, 26, the strip 10 includes cosmetic samples 54 which are arranged such that each of the pieces 22, 24, 26, 28, 30 contains one of the samples 54. Each of the samples 54 can be a transferable cosmetic preparation, such as lipstick, rouge or mascara, or color swatches. Of course, it should be understood that the strip 10 does not have to contain the samples 54, regardless of whether they consist of a cosmetic preparation, a color swatch or any other conceivable type of sample. Thus, the strip 10 could simply bear a number or some other type of identifying indicia.

In order to inhibit the samples 54 from becoming contaminated before they are dispensed, a protective covering 56, which is preferably transparent, is applied to the upper surface 12 of the strip 10. The covering 56 also functions to inhibit the smearing or other inadvertent dispersion of the samples 54. For instance, without the covering 56, the samples 54 would tend to rub off onto the lower surface 14 of the strip 10 when the strip 10 is provided in the form of a roll (see FIG. 2). It should also be noted that the dividing lines 20 extend through the covering 56 (see FIGS. 5A and 5B). Thus, the covering 56, like the strip 10 itself, is divided into a plurality of individual pieces arranged seriatim and connected in end-to-end fashion, such pieces of the covering 56 matching the pieces 22, 24, 26, 28, 30 of the strip 10. The covering 56 is releaseably adhered to the strip 10 along the side edges 16, 18 only. Thus, when, for instance, the piece 22 is separated from the piece 24, the piece of the covering 56 overlying the piece 24 can be readily lifted from the nose section 40 of the piece 24 to thereby expose at least the portion of the sample 54 contained on the nose section 40 (this general condition being illustrated in FIG. 2). If desired, the portion of the covering 56 overlying the entire piece 24 could be completely removed, thereby exposing the sample 54 in its entirety.

Figure 2:
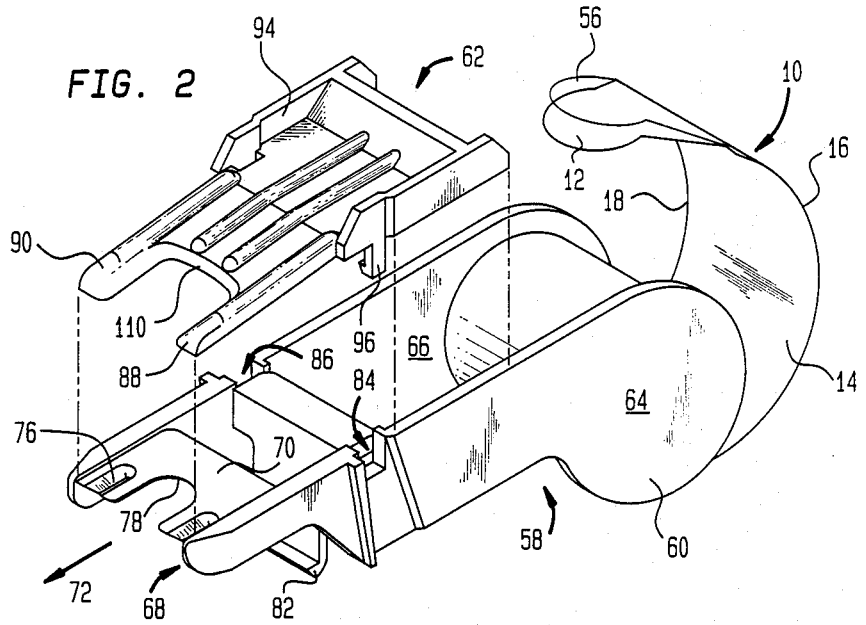
FIG. 2 is an exploded perspective view of a cartridge constructed in accordance with another aspect of the present invention and adapted to dispense the sample strip shown in FIG. 1.
Figure 3:
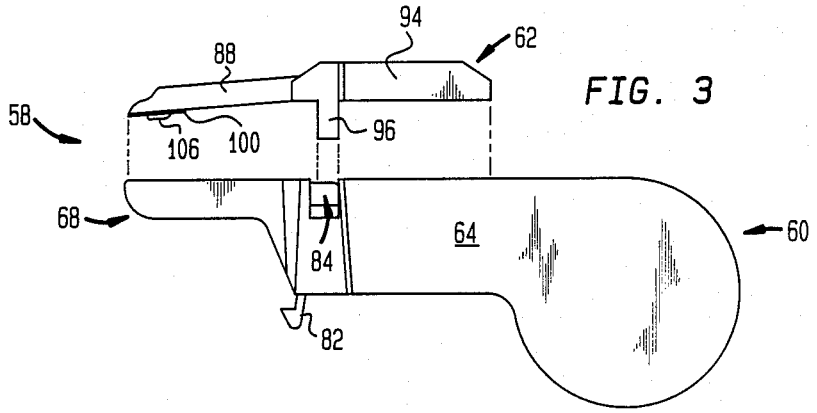
FIG. 3 is an exploded side elevational view of the cartridge illustrated in FIG. 2.
Figure 4:
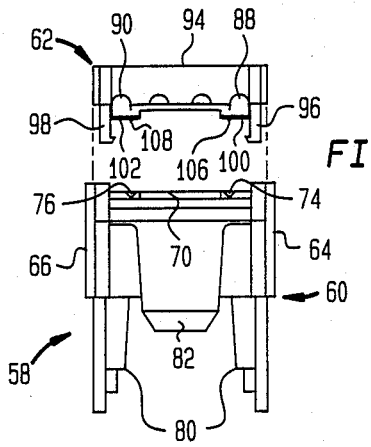
FIG. 4 is an exploded front elevational view of the cartridge illustrated in FIG. 2.

With particular reference now being made to FIGS. 2–4, a cartridge 58 for dispensing the strip 10 includes a body 60 and a head 62. The body 60 has sidewalls 64, 66. A dispensing tip 68 is formed at one end of the body 60, the dispensing tip 68 including a runway 70 adapted to support the lower surface 14 of the strip 10 as the strip 10 is fed through the dispensing tip 68 in the direction of arrow 72 during a dispensing operation. The runway 70 is provided with recesses 74, 76 and a notch 78 whose functions will be described below. The opposite end of the body 60 includes ears 80 (see FIG. 4) adapted to receive a core (not shown) on which the strip 10 is wound such that the strip 10 can be unwound as it is fed incrementally through the dispensing tip 68. A clip 82, the function of which will be described below, is suspended between the sidewalls 64, 68. Openings 84, 86 formed in the sidewalls 64, 66, respectively, flank the clip 82 for a purpose to be described below.

The head 62 includes resilient fingers 88, 90 which are cantilevered from a bridge 94 which rests on the sidewalls 64, 66 of the body 60. Hooks 96, 98 depend from opposite sides of the bridge 94 so as to releaseably engage the openings 84, 86, respectively, in the sidewalls 64, 66, respectively, of the body 60, when the head 62 is applied to the body 60. The fingers 88, 90 are arranged at an inclined angle selected such that contact pads 100, 102 provided on the free ends of the fingers 88, 90, respectively, are pressed against the runway 70, whereby the fingers 88, 90 themselves extend into a passageway 104 (see FIGS. 5A–5C) through which the strip 10 passes during a dispensing operation to be described in greater detail below. Before discussing the dispensing operation, it should be noted that the fingers 88, 90 extend far enough into the passageway 104 to create an interference fit for the strip 10. Despite the existence of this interference fit, the natural resiliency of the fingers 88, 90 permits them to be deflected away from the runway 70 by the strip 10 upon the initial feeding of the strip 10 into the passageway 104, whereby the strip 10 is interposed between the runway 70 and the contact pads 100, 102 of the fingers 88, 90, respectively. Also, although cutting ribs 106, 108 depend from the contact pads 100, 102, respectively, the contact pads 100, 102 are able to engage the covering 56 of the strip 10 due to the alignment of the ribs 106, 108 with the recesses 74, 76, respectively, (see FIGS. 5A–5C) for a purpose to be described below.

Figure 5A:
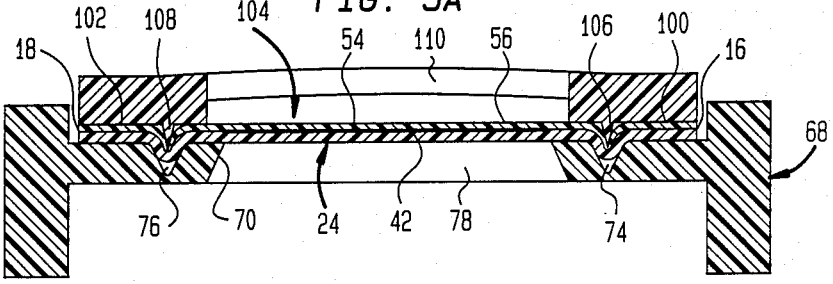
FIG. 5A is a cross-sectional view which shows the relationship between the cartridge illustrated in FIG. 2 and the sample strip illustrated in FIG. 1 during one stage of a strip-dispensing operation, the cross section of the strip being taken along line 5A—5A in FIG. 1.
Figure 5B:
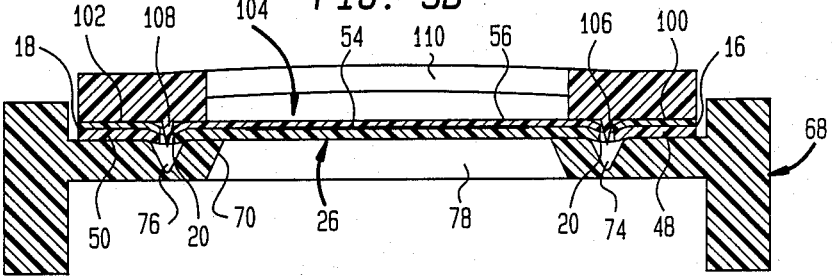
FIG. 5B is a cross-sectional view which is similar to FIG. 5A but which shows a further operating stage, this time the cross section of the strip being taken along line 5B—5B in FIG. 1.
Figure 5C:
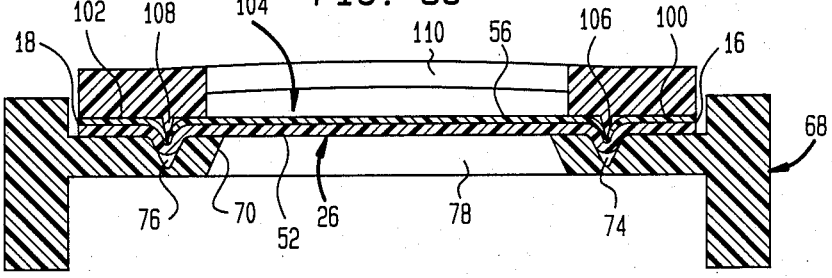
FIG. 5C is a cross-sectional view which is similar to FIG. 5A but which shows a still further operating stage, this time the cross section of the strip being taken along line 5C—5C in FIG. 1.
Figure 8:
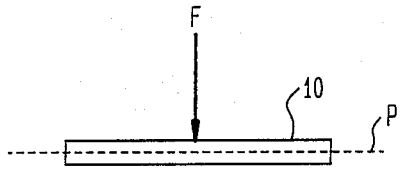
FIG. 8 is a schematic illustration showing the force vector exerted on a sample strip by the cartridge of FIGS. 2–4.
Figure 9:
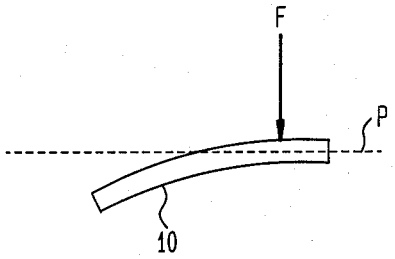
FIG. 9 is a schematic illustration showing the force vector exerted on a sample strip by a cartridge which is a modified version of the one illustrated in FIGS. 2–4.

Making general reference to FIG. 1 and particular reference to FIGS. 5A–5C and assuming that the piece 22 and any preceding pieces (not shown) have been removed from the strip 10 to thereby leave the piece 24 as the so-called "leading piece" and the piece 26 as the so-called "trailing piece", the fingers 88, 90 cooperate with the runway 70 to constantly squeeze the leading piece 24, including the matching piece of the covering 56, between the contact pads 100, 102 and the runway 70. As a result of such squeezing action, a compressive force is exerted against the marginal portions of the midsection 42 of the leading piece 24 (i.e., those portions of the midsection 42 which lie adjacent to the side edges 16, 18 of the strip 10), such force having a component acting in a direction generally normal to an imaginary plane (P) containing the runway 70 (see FIG. 5A) in the event that the strip 10 is flat (see FIG. 8), or to an imaginary plane (P) which is tangent to the strip 10 in the even that the strip 10 is curved (see FIG. 9). At this stage of the dispensing operation, the cutting ribs 106, 108 push two laterally spaced portions of the strip 10 into the recesses 74, 76, respectively, without actually cutting or otherwise weakening the strip 10.

As the leading piece 24 is pulled outwardly from the dispensing tip 68 in the direction of the arrow 72, the contact pads 100, 102 of the fingers 88, 90, respectively, engage the portions of the covering 56 which overlie the legs 48, 50 of the tail section 44 such that most if not all of the compressive force is still exerted against the leading piece 24 (see FIG. 5B). At this stage of the dispensing operation, the cutting ribs 106, 108 reach the dividing line 20 (which extends through the covering 56 as well as the strip 10 itself) just before they reach the nicks 34, 36, respectively. Upon reaching the nicks 34, 36, the ribs 106, 108 sever or otherwise weaken the nicks 34, 36, whereby the tensile force required to separate the leading piece 24 from the trailing piece 26 is reduced to thereby facilitate such separation. If the legs 48, 50 tear during this stage of the dispensing operation as they are apt to do because of their narrow width, the torn portions of the legs 48, 50 will not become jammed in the recesses 74,76 of the runway 70 due to the fact that the recesses 74, 76 are open in the direction of the arrow 72 (see FIG. 2).

When, as a result of the further movement of the leading piece 24 in the direction of the arrow 72, the contact pads 100, 102 disengage the portions of the covering 56 which overlie the legs 48, 50, the compressive force exerted by the fingers 88, 90 through the contact pads 100, 102 is now exerted on the midsection 52 of the trailing piece 26, thereby creating drag on the trailing piece 26 (see FIG. 5C). By calculating the drag such that it is greater than the tensile force required to separate the leading piece 24 from the trailing piece 26, the leading piece 24 can be separated from the trailing piece 26 by pulling on the leading piece 24 as the trailing piece 26 is maintained in the dispensing tip 68 due to the drag which acts on the trailing piece 26 to inhibit its movement as the leading piece 24 is separated therefrom.

While continuing to make specific reference to FIGS. 5A–5C but while also making reference to FIG. 2, a notch 110 formed between the fingers 88, 90 of the head 62 communicates with the passageway 104 on one side thereof, the passageway 104 communicating on an opposite side with the notch 78 formed in the runway 70 of the body 60. The notches 78, 110 cooperate to facilitate the gripping of the strip 10 when the strip 10 is present in the dispensing tip 68.

Figure 6:
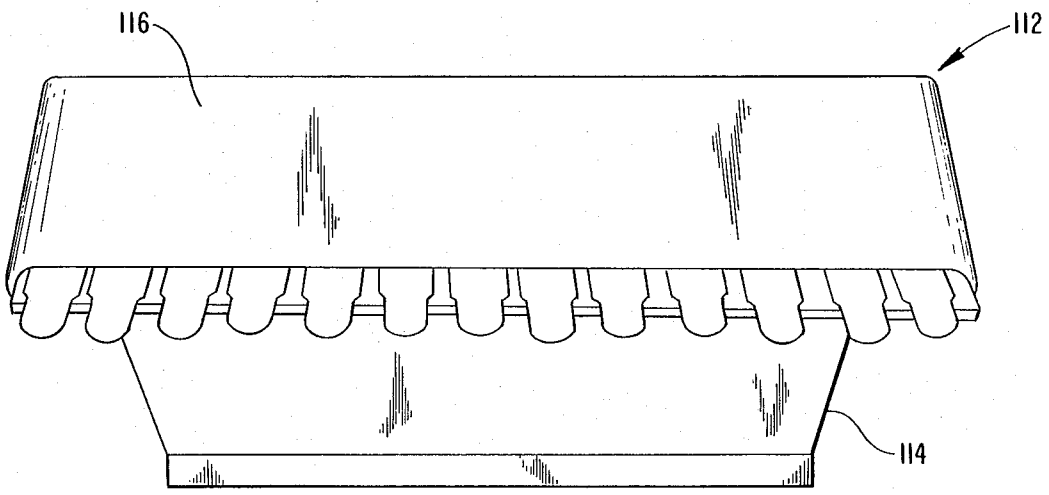
FIG. 6 is front perspective view of a display unit adapted to receive the cartridge illustrated in FIGS. 2–4, as well as a number of similar cartridges, for the purpose of dispensing a number of strips like the one illustrated in FIG. 1.

With reference now to FIG. 6, a display unit 112 includes a single row of sample strips, each of which is identical to the sample strip 10 and which is mounted on a cartridge (see FIG. 7) identical to the cartridge 58. Alternatively, the display unit 112, which includes a base 114 and a moveable lid 116, could be provided with two or more rows of sample strips arranged one above the other.

Figure 7:
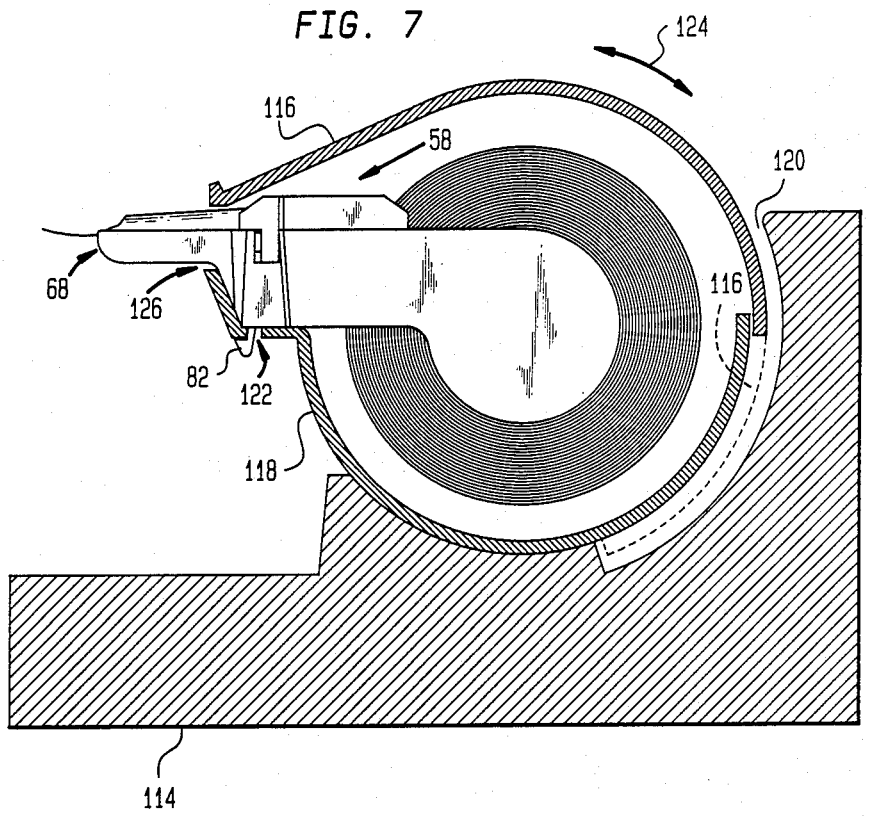
FIG. 7 is cross-sectional view which illustrates how the strip of FIG. 1 and the cartridge of FIGS. 2–4 are mounted in the display unit of FIG. 6.

Referring to FIG. 7, the cartridge 58 is removeably inserted into a casing 118 which is mounted in a socket 120 provided in the base 114. More particularly, an opening 122 in the casing 118 receives the hook 82 of the cartridge 58 such that the cartridge 58 can be inserted into or removed from the casing 118 by deflecting the hook 82. The lid 116 can be rotated in the direction of arrow 124 relative to the casing 118 between a closed position (indicated in solid lines), in which the lid 116 substantially covers the cartridge 58 after its insertion into the casing 118, and an open position (indicated in phantom), in which the lid 116 uncovers the casing 118 to permit the insertion or removal of the cartridge 58. When the cartridge 58 is in place, the discharge tip 68 thereof extends outwardly from a discharge slot 126 formed between the lid 116 and the casing 118.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

We claim:

1. A strip in combination with a dispenser, the dispenser including a dispensing tip and a pair of force-exerting members adapted to exert a force against said strip as said strip passes through the dispensing tip, said strip comprising a pair of side edges and dividing lines which extend across said strip from one of said side edges to the other of said side edges and which are spaced apart along the length of said strip such that said strip is divided into a plurality of individual pieces arranged seriatim and connected in end-to-end fashion, each of said pieces containing a sample and including a nose section which has a size and shape selected such that said nose section is spaced from both of said side edges of said strip, a midsection which extends rearwardly from said nose section to a nose section of a trailing piece and which extends across said strip from one of said side edges to the other of said side edges,.and a tail section which includes a pair of legs extending rearwardly from said midsection to a midsection of the trailing piece, one of said legs being arranged adjacent to one of said side edges of said strip and the other of said legs being arranged adjacent to the other of said side edges of said strip such that said legs straddle the nose section of the trailing piece so as to present contact surfaces for the force-exerting members of the dispenser as the strip passes through the dispensing tip, whereby the force-exerting members do not exert any substantial force on the trailing piece until the midsection of the trailing piece reaches the force-exerting members at which time the leading piece can be separated from the trailing piece along one of said dividing lines by pulling on the leading piece as the trailing piece is maintained substantially stationary due to the force exerted on the midsection thereof by the force-exerting members, and both of said legs having a length selected such that upon the separation of the leading piece from the trailing piece the nose section of the trailing piece, which now becomes a leading piece, projects outwardly from the dispensing tip a distance sufficient to permit it to be gripped by a user.

2. A strip according to claim 1, wherein each of said sample is a cosmetic product sample.

3. A strip according to claim 1, wherein each of said pieces contains a transferable test sample, said test samples being applied to one surface of said strip.

4. A strip according to claim 3, wherein said strip is in the form of a roll.

5. A strip according to claim 4, wherein said strip includes a covering removably applied to said one surface of said strip, whereby said covering prevents contamination of said samples and prevents said samples from being rubbed off onto an opposite surface of said strip.

6. A strip according to claim 1, wherein said strip includes nicks which interrupt each of said dividing lines at preselected locations therealong to thereby connect each of said pieces to an adjoining piece, said dividing lines otherwise extending completely through said strip.

7. A dispenser for a strip which is divided into a plurality of individual pieces arranged seriatim and connected in end-to-end fashion, said dispenser comprising a dispensing tip, having a passageway through which the strip passes during a dispensing operation, first exerting means for constantly exerting a compressive force against one marginal edge only of the strip in a direction generally perpendicular to a longitudinal axis of the strip when the strip is flat, and second exerting means for constantly exerting a compressive force against an opposite marginal edge only of the strip in a direction generally perpendicular to the longitudinal axis of the strip when the strip is flat, said first and second exerting means cooperating as a result of the compressive forces exerted thereby to create drag on a trailing piece of the strip which trailing piece is supplied to said dispensing tip as a result of the withdrawal from said dispensing tip of a leading piece of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, but not so great as to prevent the trailing piece from being moved through and out of said passageway of said dispensing tip.

8. A dispenser according to claim 7, wherein said first exerting means includes first supporting means for supporting one surface of the strip and first contacting means for contacting an opposite surface of the strip in the vicinity of the one marginal edge thereof, said first contacting means being yieldingly urged toward said first supporting means, whereby said first supporting means and said first contacting means cooperate with each other to squeeze the strip therebetween, and wherein said second exerting means includes second supporting means for supporting the one surface of the strip and second contacting means for contacting the opposite surface of the strip in the vicinity of the opposite marginal edge thereof, said second contacting means being yieldingly urged toward said second supporting means, whereby said second supporting means and said second contacting means cooperate with each other to squeeze the strip therebetween.

9. A dispenser according to claim 8, wherein said dispenser includes a cartridge having a head and a body.

10. A dispenser according to claim 9, wherein said body of said cartridge includes a runway, said first and second supporting means being provided on said runway, and wherein said head of said cartridge includes a pair of cantilevered fingers, one of said fingers functioning as said first contacting means and having a free end which is yieldingly urged into contact with said first supporting means on said runway and the other of said fingers functioning as said second contacting means and having a free end which is yieldingly urged into contact with said second supporting means on said runway.

11. A dispenser according to claim 10, wherein said free end of each of said fingers includes a contact pad.

12. A dispenser according to claim 11, wherein said free end of each of said fingers includes severing means for severing the strip so as to promote its separation into individual pieces.

13. A dispenser according to claim 12, wherein each of said severing means includes a rib depending from a corresponding one of said contact pads.

14. A dispenser according to claim 13, wherein said severing means includes a pair of recesses provided in said runway, each of said recesses being aligned with a corresponding one of said ribs.

15. A dispenser according to claim 14, wherein each of said recesses has a leading end which is open.

16. A dispenser according to claim 10, wherein said fingers have a natural resiliency which permits them to be deflected away from said runway in response to the feeding of the strip into said passageway to thereby permit the strip to pass through said dispensing tip.

17. A dispenser according to claim 16, wherein the strip is in the form of a roll and said body of said cartridge includes holding means for holding the roll such that the strip can be unwound therefrom.

18. A dispenser according to claim 17, wherein said body of said cartridge includes mounting means for removeably mounting said cartridge in a housing.

19. A dispenser according to claim 10, further comprising a first notch formed between said fingers of said head and a second notch formed in said runway of said body, said first and second notches being in general alignment with each other so as to aid a user in gripping the strip when the strip is present in said dispensing tip.

20. In combination, a strip which is provided in the form of a roll and a dispenser which includes a dispensing tip, first exerting means for exerting a force against one marginal edge of said strip as said strip is unwound from said roll and passes through said dispensing tip and second exerting means for exerting a force against an opposite marginal edge of said strip as said strip is unwound from said roll and passes through said dispensing tip, said strip including dividing lines which extend across said strip from said one marginal edge to said opposite marginal edge and which are spaced apart along the length of said strip such that said strip is divided into a plurality of individual pieces arranged seriatim and connected in end-to-end fashion, each of said pieces including a nose section which has a size and shape selected such that said nose section is spaced from both of said marginal edges of said strip, a midsection which extends rearwardly from said nose section to a nose section of a trailing piece and which extends across said strip from said one marginal edge to said opposite marginal edge, and a tail section which includes a pair of legs extending rearwardly from said midsection to a midsection of the trailing piece, one of said legs being arranged adjacent to said one marginal edge of said strip and the other of said legs being arranged adjacent to said opposite marginal edge of said strip such that said legs straddle the nose section of the trailing piece so as to present contact surfaces for said first and second exerting means respectively as said strip passes through said dispensing tip, whereby said first and second exerting means do not exert any substantial force on the trailing piece until the midsection of the trailing piece reaches said first and second exerting means at which time the leading piece can be separated from the trailing piece along one of said dividing lines by pulling on the leading piece as the trailing piece is maintained substantially stationary due to the force exerted on the midsection thereof by said first and second exerting means, and both of said legs having a length selected such that upon the separation of the leading piece from the trailing piece a nose section of the trailing piece, which now becomes a leading piece, projects outwardly from said dispensing tip a distance sufficient to permit it to be gripped by a user.

21. A combination according to claim 20, wherein each of said pieces contains a transferable test sample, said test samples being applied to one surface of said strip.

22. A combination according to claim 21, wherein said dispenser includes holding means for holding said roll such that said strip can be unwound from said roll as it is incrementally fed through said dispensing tip.

23. A combination according to claim 22, wherein said strip includes a covering removably applied to said one surface of said strip, whereby said covering prevents contamination of said samples and inhibits said samples from being rubbed off onto an opposite surface of said strip.

24. A combination according to claim 23, wherein said strip includes nicks which interrupt each of said dividing lines at preselected locations therealong to thereby connect each of said pieces to an adjoining piece, said dividing lines otherwise extending completely through said strip, and wherein said dispenser includes severing means for severing at least some of said nicks prior to separating the two adjoining pieces attached by said nicks.

25. A combination according to claim 24, wherein said exerting means includes supporting means for supporting said opposite surface of said strip and first contacting means for contacting portions only said one surface of said strip in the vicinity of said one marginal edge thereof, said first contacting means being yieldingly urged toward said first supporting means, whereby said first supporting means and said first contacting means cooperate with each other to squeeze said strip therebetween, and wherein said second exerting means includes second supporting means for supporting said opposite surface of said strip and second contacting means for contacting said one surface of said strip in the vicinity of said opposite marginal edge thereof, said second contacting means being yieldingly urged toward said second supporting means, whereby said second supporting means and said second contacting means cooperate with each other to squeeze said strip therebetween.

26. A combination according to claim 25, wherein said dispenser is in the form of a disposable cartridge, said cartridge including mounting means for removeably mounting said cartridge in a housing.

27. Apparatus for dispensing a sample strip roll which is divided into a plurality of individual pieces arranged seriatim and connected in end-to-end fashion, comprising a housing and a plurality of cartridge-type dispensers, each of said dispensers including holding means for holding the sample strip roll such that the strip can be unwound therefrom, a dispensing tip, having a passageway through which the strip passes as it is unwound during a dispensing operation, first exerting means for constantly exerting a compressive force against one marginal edge only of an unwound portion of the strip in a direction generally perpendicular to a longitudinal axis of the unwound portion of the strip when the unwound portion of the strip is flat and second exerting means for constantly exerting a compressive force against an opposite marginal edge only of the unwound portion of the strip in a direction generally perpendicular to the longitudinal axis of the unwound portion of the strip when the unwound portion of the strip is flat, said first and second exerting means cooperating as a result of the compressive forces exerted thereby to create drag on a trailing piece of the unwound portion of the strip which trailing piece is supplied to said dispensing tip as a result of the withdrawal from said dispensing tip of a leading piece of the unwound portion of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, but not so great as to prevent the trailing piece from being moved through and out of said passageway of said dispensing tip.

28. Apparatus according to claim 27, further comprising mounting means for removeably mounting said dispensers in said housing.

29. Apparatus according to claim 28, wherein said dispensers are arranged in a row within said housing such that said dispensing tips extend outwardly from said housing through a common discharge slot therein.

30. A dispenser for a strip which is divided into a plurality of individual pieces arranged seriatim and connected in end-to-end fashion, said dispenser comprising a dispensing tip, having a passageway through which the strip passes during a dispensing operation, first exerting means for constantly exerting a compressive force against one marginal edge only of the strip in a direction generally perpendicular to an imaginary line which is tangent to a longitudinal axis of the strip when the strip is curved, and second exerting means for constantly exerting a compressive force against an opposite marginal edge only of the strip in a direction generally perpendicular to the imaginary line which is tangent to the longitudinal axis of the strip when the strip is curved, said first and second exerting means cooperating as a result of the compressive forces exerted thereby to create drag on a trailing piece of the strip which trailing piece is supplied to said dispensing tip as a result of the withdrawal from said dispensing tip of a leading piece of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, but not so great as to prevent the trailing piece from being moved through and out of said passageway of said dispensing tip.

31. A dispenser according to claim 30, wherein said first exerting means includes first supporting means for supporting one surface of the strip and first contacting means for contacting an opposite surface of the strip in the vicinity of the one marginal edge thereof, said first contacting means being yieldingly urged toward said first supporting means, whereby said first supporting means and said first contacting means cooperate with each other to squeeze the strip therebetween, and wherein said second exerting means includes second supporting means for supporting the one surface of the strip and second contacting means for contacting the opposite surface of the strip in the vicinity of the opposite marginal edge thereof, said second contacting means being yieldingly urged towards said second supporting means, whereby said second supporting means and second contacting means cooperate with each other to squeeze the strip therebetween.

32. A dispenser according to claim 31, wherein said dispenser includes a cartridge having a head and a body.

33. A dispenser according to claim 32, wherein said body of said cartridge includes a runway, said first and second supporting means being provided on said runway, and wherein said head of said cartridge includes a pair of cantilevered fingers, one of said fingers functioning as said first contacting means and having a free end which is yieldingly urged into contact with said first supporting means on said runway and the other of said fingers functioning as said second contacting means and having a free end which is yieldingly urged into contact with said second supporting means on said runway.

34. A dispenser according to claim 33, wherein said free end of each of said fingers includes a contact pad.

35. A dispenser according to claim 34, wherein said free end of each of said fingers includes severing means for severing the strip so as to promote its separation into individual pieces.

36. A dispenser according to claim 35, wherein each of said severing means includes a rib depending from a corresponding one of said contact pads.

37. A dispenser according to claim 36, wherein said severing means includes a pair of recesses provided in said runway, each of said recesses being aligned with a corresponding one of said ribs.

38. A dispenser according to claim 37, wherein each of said recesses has a leading end which is open.

39. A dispenser according to claim 33, wherein said fingers have a natural resiliency which permits them to be deflected away from said runway in response to the feeding of the strip into said passageway to thereby permit the strip to pass through said dispensing tip.

40. A dispenser according to claim 39, wherein the strip is in the form of a roll and said body of said cartridge includes holding means for holding the roll such that the strip can be unwound therefrom.

41. A dispenser according to claim 40, wherein said body of said cartridge includes mounting means for removeably mounting said cartridge in a housing.

42. A dispenser according to claim 33, further comprising a first notch formed between said fingers of said head and a second notch formed in said runway of said body, said first and second notches being in general alignment with each other so as to aid a user in gripping the strip when the strip is present in said dispensing tip.

43. A dispenser for a strip which is divided into a plurality of individual pieces arranged seriatim and connected in end-to-end fashion, said dispenser comprising a cartridge having a head, a body, a dispensing tip, having a passageway through which the strip passes during a dispensing operation, and exerting means for constantly exerting a compressive force against marginal portions only of the strip in a direction generally perpendicular to a longitudinal axis of the strip when the strip is flat to thereby create drag on a trailing piece of the strip which trailing piece is supplied to said dispensing tip as a result of the withdrawal from said dispensing tip of a leading piece of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, said exerting means including supporting means for supporting one surface of the strip and contacting means for contacting an opposite surface of the strip in the vicinity of the marginal portions thereof, said contacting means being yieldingly urged toward said supporting means, whereby said supporting means and said contacting means cooperate with each other to squeeze the strip therebetween, said supporting means including a runway provided on said body of said cartridge and said contacting means including a pair of fingers cantilevered from said head of said cartridge, each of said fingers having a free end which is yieldingly urged into contact with said runway, said free end of each of said fingers including a contact pad and severing means for severing the strip so as to provide its separation into individual pieces.

44. A dispenser according to claim 43, wherein each of said severing means includes a rib depending from a corresponding one of said contact pads.

45. A dispenser according to claim 44, wherein said severing means includes a pair of recesses provided in said runway, each of said recesses being aligned with a corresponding one of said ribs.

46. A dispenser according to claim 45, wherein each of said recesses has a leading end which is open.

47. A dispenser for a strip which is divided into a plurality of individual pieces arranged seriatim and connected in end-to-end fashion, said dispenser comprising a cartridge having a head, a body, a dispensing tip, having a passageway through which strip passes during a dispensing operation, and exerting means for constantly exerting a compressive force against marginal portions only of the strip in a direction generally perpendicular to an imaginary line which is tangent to a longitudinal axis of the strip when the strip is curved to thereby create drag on a trailing piece of the strip which trailing piece is supplied to said dispensing tip as a result of the withdrawal from said dispensing tip of a leading piece of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, said exerting means including supporting means for supporting one surface of the strip and contacting means for contacting an opposite surface of the strip in the vicinity of the marginal portions thereof, said contacting means being yieldingly urged toward said supporting means, whereby said supporting means and said contacting means cooperate with each other to squeeze the strip therebetween, said supporting means including a runway provided on said body of said cartridge and said contacting means including a pair of fingers cantilevered from said head of said cartridge, each of said fingers having a free end which is yieldingly urged into contact with said runway, said free end of each of said fingers including a contact pad and severing means for severing the strip so as to promote its separation into individual pieces.

48. A dispenser according to claim 47, wherein each of said severing means includes a rib depending from a corresponding one of said contact pads.

49. A dispenser according to claim 48, wherein said severing means includes a pair of recesses provided in said runway, each of said recesses being aligned with a corresponding one of said ribs.

50. A dispenser according to claim 49, wherein each of said recesses has a leading end which is open.

51. A dispenser for a strip which is divided into a plurality of individual pieces arranged seriatim and connected in end-to-end fashion, said dispenser comprising a cartridge having a head, a body, a dispensing tip, having a passageway through which the strip passes during a dispensing operation, and exerting means for constantly exerting a compressive force against marginal portions only of the strip in a direction generally perpendicular to a longitudinal axis of the strip when the strip is flat to thereby create drag on a trailing piece of the strip which trailing piece is supplied to said dispensing tip as a result of the withdrawal from said dispensing tip of a leading piece of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, said exerting means including supporting means for supporting one surface of the strip and contacting means for contacting an opposite surface of the strip in the vicinity of the marginal portions thereof, said contacting means being yieldingly urged toward said supporting means, whereby said supporting means and said contacting means cooperate with each other to squeeze the strip therebetween, said supporting means including a runway provided on said body of said cartridge and said contacting means including a pair of fingers cantilevered from said head of said cartridge, each of said fingers having a free end which is yieldingly urged into contact with said runway and having a natural resiliency which permits it to be deflected away from said runway in response to the feeding of the strip into said passageway to thereby permit the strip to pass through said dispensing tip.

52. A dispenser according to claim 51, wherein the strip is in the form of a roll and said body of said cartridge includes holding means for holding the roll such that the strip can be unwound therefrom.

53. A dispenser according to claim 52, wherein said body of said cartridge includes mounting means for removably mounting said cartridge in a housing.

54. A dispenser for a strip which is divided into a plurality of individual pieces arranged seriatim and connected in end-to-end fashion, said dispenser comprising a cartridge having a head, a body, a dispensing tip, having a passageway through which the strip passes during a dispensing operation, and exerting means for constantly exerting a compressive force against marginal portions only of the strip in a direction generally perpendicular to an imaginary line which is tangent to a longitudinal axis of the strip when the strip is curved to thereby create drag on a trailing piece of the strip which trailing piece is supplied to said dispensing tip as a result of the withdrawal from said dispensing tip of a leading piece of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, said exerting means including supporting means for supporting one surface of the strip and contacting means for contacting an opposite surface of the strip in the vicinity of the marginal portions thereof, said contacting means being yieldingly urged toward said supporting means, whereby said supporting means and said contacting means cooperate with each other to squeeze the strip therebetween, said supporting means including a runway provided on said body of said cartridge and said contacting means including a pair of fingers cantilevered from said head of said cartridge, each of said fingers having a free end which is yieldingly urged into contact with said runway and having a natural resiliency which permits it to be deflected away from said runway in response to the feeding of the strip into said passageway to thereby permit the strip to pass through said dispensing tip.

55. A dispenser according to claim 54, wherein the strip is in the form of a roll and said body of said cartridge includes holding means for holding the roll such that the strip can be unwound therefrom.

56. A dispenser according to claim 55, wherein said body of said cartridge includes mounting means for removably mounting said cartridge in a housing.

57. Apparatus for dispensing a sample strip roll which is divided into a plurality of individual pieces arranged seriatim and connected in end-to-end fashion, comprising a housing and a plurality of cartridge-type dispensers, each of said dispensers including holding means for holding the sample strip roll such that the strip can be unwound therefrom, a dispensing tip, having a passageway through which the strip passes as it is unwound during a dispensing operation, first exerting means for constantly exerting a compressive force against one marginal edge only of an unwound portion of the strip in a direction generally perpendicular to an imaginary line which is tangent to a longitudinal axis of the unwound portion of the strip when the unwound portion of the strip is curved, and second exerting means for constantly exerting a compressive force against an opposite marginal edge only of the unwound portion of the strip in a direction generally perpendicular to the imaginary line which is tangent to the longitudinal axis of the unwound portion of the strip when the unwound portion of the strip is curved, said first and second exerting means cooperating as a result of the compressive forces exerted thereby to create drag on the trailing piece of the unwound portion of the strip which trailing piece is supplied to said dispensing tip as a result of the withdrawal from said dispensing tip of a leading piece of the unwound portion of the strip which leading piece is connected to the trailing piece, such drag being greater than the tensile force required to separate the leading piece from the trailing piece, whereby the leading piece can be separated from the trailing piece by pulling on the leading piece as the trailing piece is maintained in said dispensing tip due to the drag which inhibits movement of the trailing piece as the leading piece is separated therefrom, but not so great as to prevent the trailing piece from being moved through and out of said passageway of said dispensing tip.

58. Apparatus according to claim 57, further comprising mounting means for removably mounting said dispensers in said housing.

59. Apparatus according to claim 58, wherein said dispensers are arranged in a row within said housing such that said dispensing tips extend outwardly from said housing through a common discharge slot therein.

* * * * *